United States Patent [19]

Price et al.

[11] Patent Number: 4,839,945

[45] Date of Patent: Jun. 20, 1989

[54] INVISIBLE TIE TAIL HOLDER

[76] Inventors: Zane A. Price, 6248 Gentle La., Alexandria, Va. 22310; Douglas P. Bentley, 8528 Cyrus Pl., Alexandria, Va. 22308

[21] Appl. No.: 253,958

[22] Filed: Oct. 4, 1988

Related U.S. Application Data

[63] Continuation of Ser. No. 141,005, Jan. 5, 1988, abandoned.

[51] Int. Cl.[4] ..... A41D 25/00

[52] U.S. Cl. ..... 24/49 R; 24/49 CP

[58] Field of Search ..... 24/49 R, 49 A, 49 CF, 24/49 CC, 49 CP, 49 P, 49 C, 49 KC, 55, 65, 546, 67.9, 547, 11 C, 3 D

[56] References Cited

U.S. PATENT DOCUMENTS

| | | | |
|---|---|---|---|
| Des. 27,138 | 6/1897 | O'Sullivan | 24/150 P |
| 230,755 | 8/1880 | Davis | 24/55 |
| 909,862 | 1/1909 | Blair | 24/11 C |
| 1,213,086 | 1/1917 | Faugno | 24/49 CF |
| 1,875,251 | 8/1932 | McKeen | 24/49 KC |
| 2,733,336 | 1/1956 | Clayton | 24/546 |
| 3,019,445 | 2/1962 | Hirsch et al. | 24/49 CP |
| 3,400,434 | 9/1968 | Pazeotopoulos | 24/49 TS |
| 4,627,132 | 12/1986 | Markham | 24/546 |

*Primary Examiner*—Victor N. Sakran

[57] ABSTRACT

The invisible tie tail holder constructed and arranged so as to hold the tail of the tie to the backside of the front of the tie without being able to see it from the front of the tie. It is constructed out of steel wire that is bent into a "c" shape which attaches by the pin grabber mechanism to back of the front of the tie and the tail of the tie is fed through the "c" shape which holds it securely to the back of the front of the tie, and it is so illustrated herein.

4 Claims, 1 Drawing Sheet

INVISIBLE TIE TAIL HOLDER

This is a continuation of application serial No. 141,005, filed Jan. 5, 1988.

FIELD OF INVENTION

This invention relates to clothing apparel generally, more specifically the invention relates to ties and securing the loose tail of the tie.

BACKGROUND OF THE INVENTION

The background of this invention was to develop a means to secure the tail of the tie to the back of the tie in a simple manner. Also to secure the tail of the tie effectively, without penetrating the front of the tie, and being invisible to the front of the tie.

SUMMARY OF THE INVENTION

The present invention is comprised of a steel wire wherein both ends are formed to a pin point. The wire is then bent into a "c" shape and the opening of the "c" ends are bent into pin grabbers that enable the device to be pinned to the back of the front of the tie. The tie tail passes through the "c" shape for holding the tail securely to the tie.

BRIEF DESCRIPTION OF THE DRAWINGS

Our invention is illustrated in the accompanying drawings, forming part of this application, in which

In FIG. 1 (a) & (b) are the components that make up the pin grabber mechanism. From the pin grabber bend the wire is straight until it is bent into a ninety degree angle and this is the connection of the pin grabber as shown in FIG. 1 (c). The wire is then formed into a "c" shape. The curved portions of the "c" shape is shown in FIG. 1 (d). The straight portion of the "c" shape is shown in FIG. 1 (e). In FIG. 1 (d) & (e) are the components that make up the "c" shaped mechanism. The "c" shaped mechanism is where the tail of the tie is pulled through so that it is securely held to the back of the front of the tie.

What is claimed is that

Figure 1:
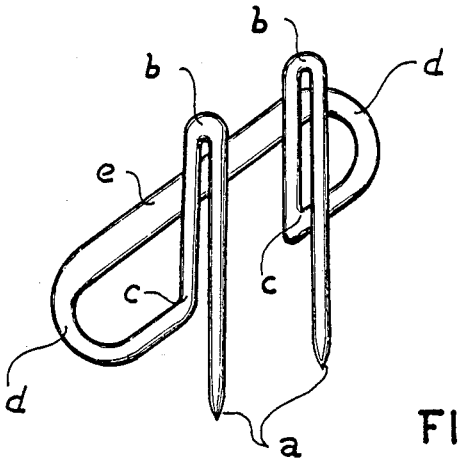
- FIG. 1 is a perspective view of the device.
Figure 2:
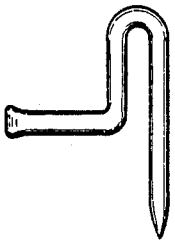
FIG. 2 is a side view of the device.
Figure 3:
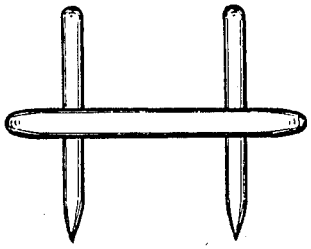
FIG. 3 is a front view of the device. DESCRIPTION OF THE PREFERRED EMBODIMENT Reference is made to the accompanying drawings specifically FIG. 1 for the general construction of the invisible tie tail holder invention. The invisible tie tail holder is constructed from a single steel wire that is bent into a shape as shown in FIG. 1. The ends of the wire are shaped into a pin point as shown in FIG. 1 (a), this enables the invisible tie tail holder to penetrate the back of the front of the tie. From the pin point ends, the wire is straight and then it is formed into a pin-grabber bend that is shown in FIG. 1 (b), this enables the invisible tie tail holder to be held securely to the back of the front of the tie.

1. An invisible tie tail holder comprising:

a "c"-shaped holder having a c-body portion and including two curved outer end portions and two inner-end portions, said "c"-shaped holder being oriented for installation in a horizontal plane about a tie tail;

a pair of pin members oriented for vertical installation in the back of the front of a tie, said pin members each having a first end, a second end, and an intermediate portion; each first end being pin-shaped for pin-engagement with the front of the back of said tie, said intermediate portions being bent into an inverted "J"-shaped member having upper and lower ends wherein each said pin-shaped first end of said pin member is located at said lower end of said inverted "J"-shaped member and each said upper end of said inverted "J"-shaped member extends to and connects with said second end of said pin members which is affixed to a different one of said two inner-end portions of said "c"-shaped holder; and, wherein said curved outer end portions of said "c"-shaped member extend horizontally beyond said pair of vertical pin members.

2. The tie tail holder of claim 1 wherein said "c"-shaped holder and said inverted "J"-shaped member are made of steel wire.

3. The tie tail holder of claim 1 wherein said intermediate portions of said inverted "J"-shaped member extend above the plane of said "c"-shaped holder and said pin-shaped portions extend below the plane of said "c"-shaped holder.

4. The tie tail holder of claim 3 wherein said "c"-shaped holder and said inverted "J"-shaped member are made of steel wire.

* * * * *